US009670932B2

(12) United States Patent
Iwamoto et al.

(10) Patent No.: US 9,670,932 B2
(45) Date of Patent: Jun. 6, 2017

(54) FAN

(71) Applicant: NIDEC CORPORATION, Minami-ku, Kyoto (JP)

(72) Inventors: Kenji Iwamoto, Kyoto (JP); Tomotsugu Sugiyama, Kyoto (JP); Yoshiaki Oguma, Kyoto (JP); Yasuyuki Kaji, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 760 days.

(21) Appl. No.: 13/714,949

(22) Filed: Dec. 14, 2012

(65) Prior Publication Data

US 2013/0209294 A1 Aug. 15, 2013

(30) Foreign Application Priority Data

Feb. 9, 2012 (JP) ..... 2012-026541

(51) Int. Cl.

| | |
|---|---|
| ***F04D 29/52*** | (2006.01) |
| ***F04D 25/08*** | (2006.01) |
| ***F04D 25/06*** | (2006.01) |
| ***F04D 29/64*** | (2006.01) |

(52) U.S. Cl.

CPC ..... *F04D 25/08* (2013.01); *F04D 25/0613* (2013.01); *F04D 29/522* (2013.01); *F04D 29/646* (2013.01)

(58) Field of Classification Search

CPC .... F04D 25/08; F04D 29/522; F04D 25/0613; F04D 29/403; F04D 29/526; F04D 29/644; F04D 29/64; F04D 29/60; F04D 29/601; H05K 7/20172; H05K 7/20009–7/202; H05K 7/20554–7/20618; H05K 7/20718–7/20754; H05K 7/20863; H05K 7/20909; H05K 7/20972; H05K 7/20581; G06F 1/203

See application file for complete search history.

(56) References Cited

U.S. PATENT DOCUMENTS

| | | | | |
|---|---|---|---|---|
| 3,237,849 A * | 3/1966 | Krell | ..... | 417/423.8 |
| 6,213,819 B1 * | 4/2001 | Fan | ..... | F04D 29/601 361/695 |

(Continued)

FOREIGN PATENT DOCUMENTS

| | | |
|---|---|---|
| JP | 5-44697 A | 2/1993 |
| JP | 09-88897 A | 3/1997 |

(Continued)

*Primary Examiner* — Bryan Lettman

(74) *Attorney, Agent, or Firm* — Keating & Bennett, LLP

(57) ABSTRACT

In a fan, a housing includes decreased thickness portions and increased thickness portions arranged alternately in a circumferential direction. A distance between a central axis and an edge increases from an air inlet toward an air outlet. An inner circumferential surface has a minimum radius smaller than a distance between the central axis and an outermost portion of the edge. At a boundary between upper and lower housing portions of the housing, the inner circumferential surface has a radius greater than the distance between the central axis and the outermost portion of the edge. The increased thickness portions include component fastening structures defining a fastening structure arranged to fit the upper and lower housing portions to each other.

19 Claims, 18 Drawing Sheets

(56) References Cited

U.S. PATENT DOCUMENTS

| | | | | |
|---|---|---|---|---|
| 6,776,576 | B2 * | 8/2004 | Lee | F04D 29/601 415/206 |
| 6,826,048 | B1 * | 11/2004 | Dean | F04D 29/601 165/122 |
| 6,827,549 | B1 | 12/2004 | Horng et al. | |
| 7,585,150 | B2 * | 9/2009 | Hsu | H05K 7/20172 415/213.1 |
| 8,172,501 | B2 | 5/2012 | Nishizawa et al. | |
| 8,757,971 | B2 * | 6/2014 | Zeng | F04D 25/0613 415/213.1 |
| 2003/0077175 | A1 | 4/2003 | Marlander et al. | |
| 2005/0123423 | A1 * | 6/2005 | Weisser | 417/423.7 |
| 2006/0286925 | A1 * | 12/2006 | Chen | F04D 25/0613 454/339 |
| 2010/0074746 | A1 * | 3/2010 | Huang | F04D 25/0613 415/220 |
| 2011/0070080 | A1 * | 3/2011 | Peng | F04D 19/007 415/214.1 |

FOREIGN PATENT DOCUMENTS

| | | | |
|---|---|---|---|
| JP | 2003-532026 | A | 10/2003 |
| WO | 03/075433 | A1 | 9/2003 |

* cited by examiner

FAN

BACKGROUND OF THE INVENTION

1. Field of the Invention

The present invention relates to a fan arranged to produce an axial air current.

2. Description of the Related Art

A housing of a fan disclosed in FIGS. 9 and 10 of WO 2003/075433 has a structure in which two segments thereof are in contact with each other on a lower side of fan blades. The radial thickness of the housing is uniform with respect to an axial direction and a circumferential direction. Both the inside diameter and the outside diameter of the housing gradually increase with decreasing height.

In a casing of a fan disclosed in JP 2003-532026, an inner shell portion is used as a guide surface. The guide surface has the shape of a truncated cone, increasing in diameter with decreasing height, except in an inlet portion thereof. An end edge of each of a plurality of blades extends along the guide surface with a clearance space defined between the end edge and the guide surface. The casing is made up of a radially inner portion and a radially outer portion.

In the case where, as disclosed in WO 2003/075433, the diameter of an inner circumferential surface of a housing is arranged to increase from an inlet side toward an outlet side, and an outer circumferential edge of each blade is arranged to spread radially outward as it extends from the inlet side toward the outlet side, the housing is sometimes constructed of upper and lower segments which are capable of being detached from each other in order to prevent interference between the housing and any blade during an assembling process. However, when the housing is constructed of the upper and lower segments which are capable of being detached from each other, it is difficult to provide a fastening structure for fitting the upper and lower segments to each other while also achieving a small size of the housing. Accordingly, in the fan disclosed in FIGS. 9 and 10 of WO 2003/075433, the fastening structure is not provided, and each of the upper and lower segments of the housing is fixed to a fan installation location through screws. Such a structure, however, does not allow the fan to be treated as a single device, which makes an operation of installing the fan troublesome.

SUMMARY OF THE INVENTION

According to a preferred embodiment of the present invention, a fan includes an impeller; a motor portion arranged to rotate the impeller about a central axis extending in a vertical direction; a tubular housing arranged to surround an outer circumference of the impeller; and a plurality of ribs, each of which is arranged to join the motor portion and the housing to each other. The impeller includes a plurality of blades arranged to extend radially outward. An upper opening of the housing is an air inlet while a lower opening of the housing is an air outlet. The housing includes a plurality of decreased thickness portions and a plurality of increased thickness portions arranged alternately in a circumferential direction. A diameter of an inner circumferential surface of the housing is arranged to increase with decreasing height between the air inlet and an axial middle portion of a radially outer edge of each blade. Below the axial middle portion of the radially outer edge of each blade, the diameter of the inner circumferential surface of the housing is arranged to increase with decreasing height, to be uniform, or to increase with decreasing height while being uniform over an area or areas. A distance between the central axis and the radially outer edge of each blade is arranged to increase from the air inlet toward the air outlet. The inner circumferential surface of the housing is arranged to have a minimum radius smaller than a distance between the central axis and an outermost portion of the radially outer edge of each blade. The housing includes an upper housing portion and a lower housing portion arranged to be in contact with a lower portion of the upper housing portion. At a boundary between the upper and lower housing portions, the inner circumferential surface of the housing is arranged to have a radius greater than the distance between the central axis and the outermost portion of the radially outer edge of each blade. The lower housing portion, the ribs, and a base portion of the motor portion are defined by a single continuous monolithic member produced by, for example, an injection molding process. The increased thickness portions include a plurality of component fastening structures defining a fastening structure arranged to fit the upper and lower housing portions to each other.

According to the above preferred embodiment of the present invention, the fastening structure arranged to fit the upper and lower housing portions to each other can be easily provided in the housing, whose inner circumferential surface includes a portion which is inclined with respect to an axial direction, while an increase in the size of the housing is reduced.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
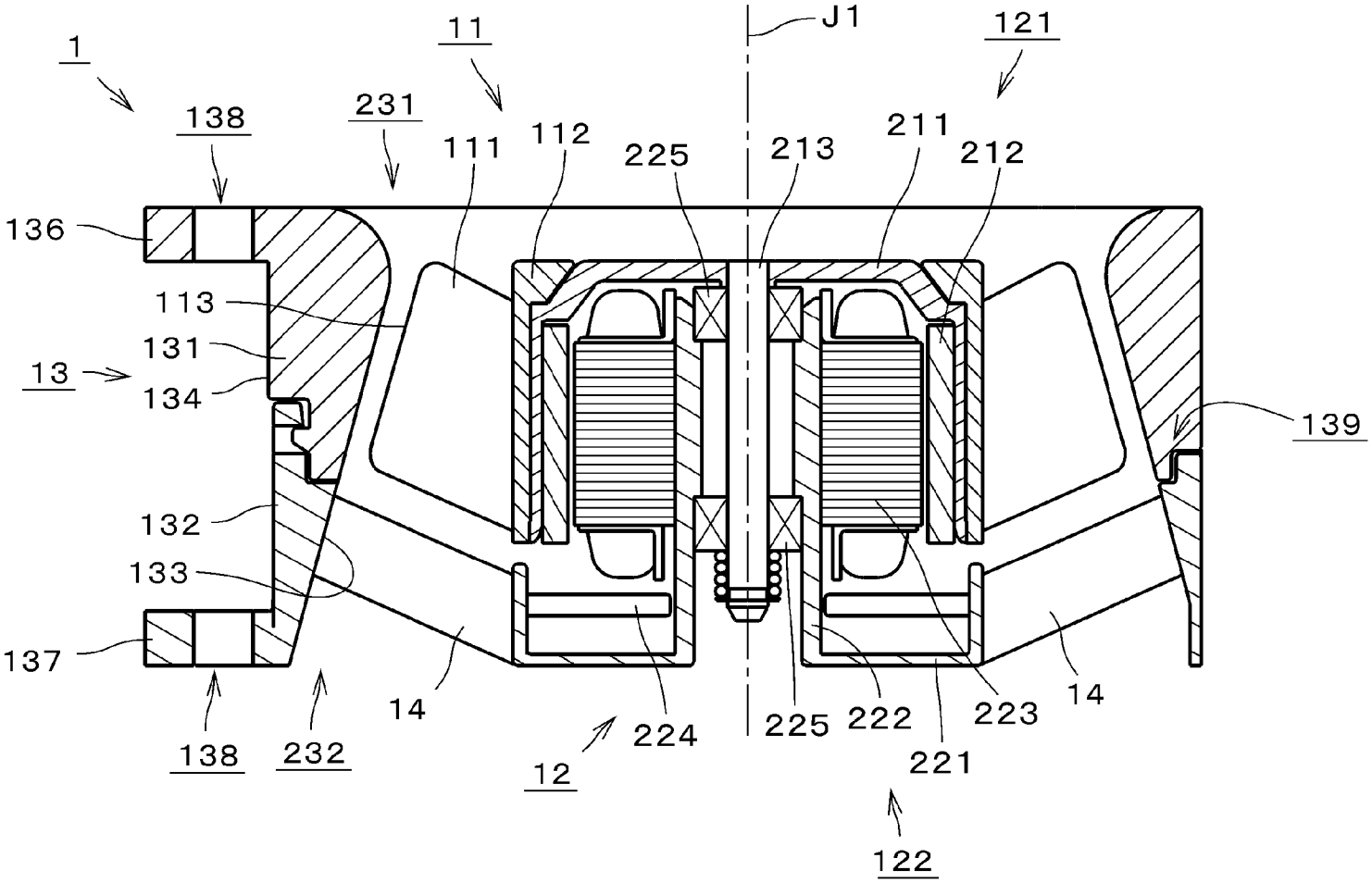
FIG. 1 is a vertical cross-sectional view of a fan according to a preferred embodiment of the present invention.

It is assumed herein that an upper side and a lower side in a direction parallel to a central axis J1 of a fan 1 in FIG. 1 are referred to simply as an upper side and a lower side, respectively. That is, the central axis J1 extends in a vertical direction. Note that the vertical direction and the upper and lower sides as defined above are not meant to indicate positional relationships or directions of members of the fan 1 installed on an actual device. It is also assumed herein that the direction parallel or substantially parallel to the central axis J1 is referred to by the term "axial direction", "axial", or "axially", that radial directions centered on the central axis J1 are simply referred to by the term "radial direction", "radial", or "radially", and that a circumferential direction about the central axis J1 is simply referred to by the term "circumferential direction", "circumferential", or "circumferentially".

FIG. 1 is a vertical cross-sectional view of a fan 1 according to a preferred embodiment of the present invention taken along a plane including the central axis J1. Parallel oblique lines are omitted for details of a section of the fan 1. The fan 1 is a so-called axial fan. The fan 1 preferably includes an impeller 11, a motor portion 12, a housing 13, and a plurality of support ribs 14. The motor portion 12 is arranged to rotate the impeller 11 about the central axis J1. The housing is tubular in shape, and is arranged to surround an outer circumference of the impeller 11. Each of the support ribs 14 is preferably arranged to join a lower portion of the motor portion and a lower portion of the housing 13 to each other. The support ribs 14 are arranged to extend radially outward from the lower portion of the motor portion 12.

The impeller 11 includes a plurality of blades 111 and a tubular portion 112. The diameter of an outer circumferential surface of the tubular portion 112 may be arranged to gradually and slightly increase with decreasing height. The blades 111 are arranged to extend radially outward from the outer circumferential surface of the tubular portion 112. The blades 111 are preferably arranged at a regular pitch in a circumferential direction. Note that, in FIG. 1, the shapes of the blades 111 and the ribs 14 are schematically shown on right and left sides of the central axis J1 for the sake of illustration.

The motor portion 12 includes a rotating portion 121, which is a rotating body, and a stationary portion 122, which is a stationary body. The rotating portion 121 is arranged on an upper side of the stationary portion 122. The tubular portion 112 is arranged to cover an outer circumference of the rotating portion 121. The rotating portion 121 preferably includes a rotor holder 211, a rotor magnet 212, and a shaft 213. The rotor holder 211 is preferably made of, for example, a metal material. The rotor holder 211 is substantially in the shape of a covered cylinder and centered on the central axis J1. The rotor magnet 212 is substantially cylindrical, and is fixed to an inner circumferential surface of the rotor holder 211. The shaft 213 is arranged to extend downward from a center of a cover portion of the rotor holder 211. The tubular portion 112 of the impeller 11 may be arranged to cover an upper surface of the rotor holder 211.

The stationary portion 122 preferably includes a base portion 221, a bearing holder 222, a stator 223, a circuit board 224, and two bearings 225. The base portion 221 is a lower portion of the stationary portion 122. The bearing holder 222 is substantially cylindrical. The bearing holder 222 is arranged to project upward from a center of the base portion 221. The stator 223 is attached to an outer circumferential surface of the bearing holder 222. The circuit board 224 is arranged between the base portion 221 and the stator 223. The base portion 221 is fixed to the lower portion of the housing 13 through the ribs 14.

The two bearings 225 are arranged inside the bearing holder 222. The bearings 225 are arranged to support the shaft 213 such that the shaft 213 is rotatable about the central axis J1. Each bearing 225 may preferably be, for example, a ball bearing, a plain bearing, etc. The stator 223 is arranged radially inside the rotor magnet 212. A torque centered on the central axis J1 is generated between the stator 223 and the rotor magnet 212.

The housing 13 is substantially cylindrical. Rotation of the impeller 11 produces a downward air current inside the housing 13. That is, an upper opening of the housing 13 is preferably an air inlet 231, while a lower opening of the housing 13 is preferably an air outlet 232. The housing 13 preferably includes an upper housing portion 131 and a lower housing portion 132. It is assumed in the present preferred embodiment that an axial position at which the diameter of an inner circumferential surface 133 of the housing 13 is smallest is the axial position of the air inlet 231, and that the axial position of a lower end of the inner circumferential surface 133 is the axial position of the air outlet 232.

An upper portion of the lower housing portion 132 is arranged to be in contact with a lower portion of the upper housing portion 131. The upper housing portion 131 is preferably molded, for example, by a resin injection molding process. The lower housing portion 132, the ribs 14, and the base portion 221 are preferably molded, for example, by a resin injection molding process as a single continuous member.

The diameter of the inner circumferential surface 133 of the housing 13 is arranged to increase from the air inlet 231 toward the air outlet 232. As shown in the right-hand side of FIG. 1, a lower portion of the inner circumferential surface 133 preferably includes a flat surface parallel or substantially parallel to the central axis J1. Meanwhile, each blade 111 is preferably shaped so that a radially outer edge 113 of the blade 111 extends along the inner circumferential surface 133. That is, the distance between the central axis J1 and the edge 113 of each of the blades 111 is preferably arranged to increase from the air inlet 231 toward the air outlet 232. It is noted that an axial fan, when structured like a mixed flow fan, exhibits an improvement in a static pressure-air volume characteristic as compared to a fan of an equivalent size.

Note that the distance between the central axis J1 and the edge 113 may not necessarily be arranged to gradually increase from the air inlet 231 toward the air outlet 232 in strict terms. For example, the edge 113 may include a slight portion parallel or substantially parallel to the central axis J1. Also note that the edge 113 may have a variety of other shapes at an upper end and a lower end thereof.

An outer circumferential surface 134 of the housing 13 is preferably arranged to extend parallel or substantially parallel to the central axis J1 except in an upper end portion and a lower end portion thereof. The radial thickness of the housing 13 is therefore arranged to decrease from the air inlet 231 toward the air outlet 232. A wind channel can thereby be expanded while securing a sufficient rigidity of the housing 13 according to the present preferred embodiment. Note that the outer circumferential surface 134 need not necessarily be parallel to the central axis J1.

Figure 2:
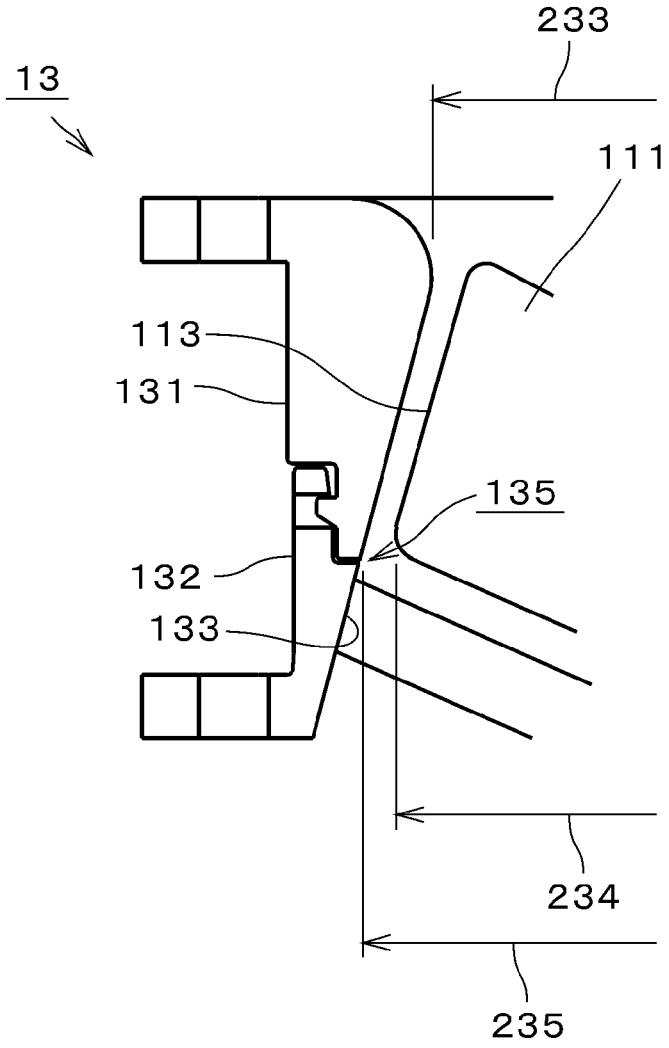
FIG. 2 is a cross-sectional view of a housing according to a preferred embodiment of the present invention.

FIG. 2 is a diagram illustrating a portion of a section of the housing 13. Parallel oblique lines indicative of the section are omitted in FIG. 2. Parallel oblique lines are also omitted appropriately in other figures referenced below. The inner circumferential surface 133 of the housing 13 is preferably arranged to have a minimum radius 233 smaller than a distance 234 between the central axis J1 and an outermost portion of the radially outer edge 113 of each blade 111. Meanwhile, at a boundary 135 between the upper and lower housing portions 131 and 132, the inner circumferential surface 133 of the housing 13 is preferably arranged to have a radius 235 greater than the distance 234 between the central axis J1 and the outermost portion of the radially outer edge 113 of each blade 111. According to the present preferred embodiment, this makes it possible to mount the upper housing portion 131 on the lower housing portion 132 in a situation in which the motor portion 12 has been assembled inside the lower housing portion 132.

Figure 3:
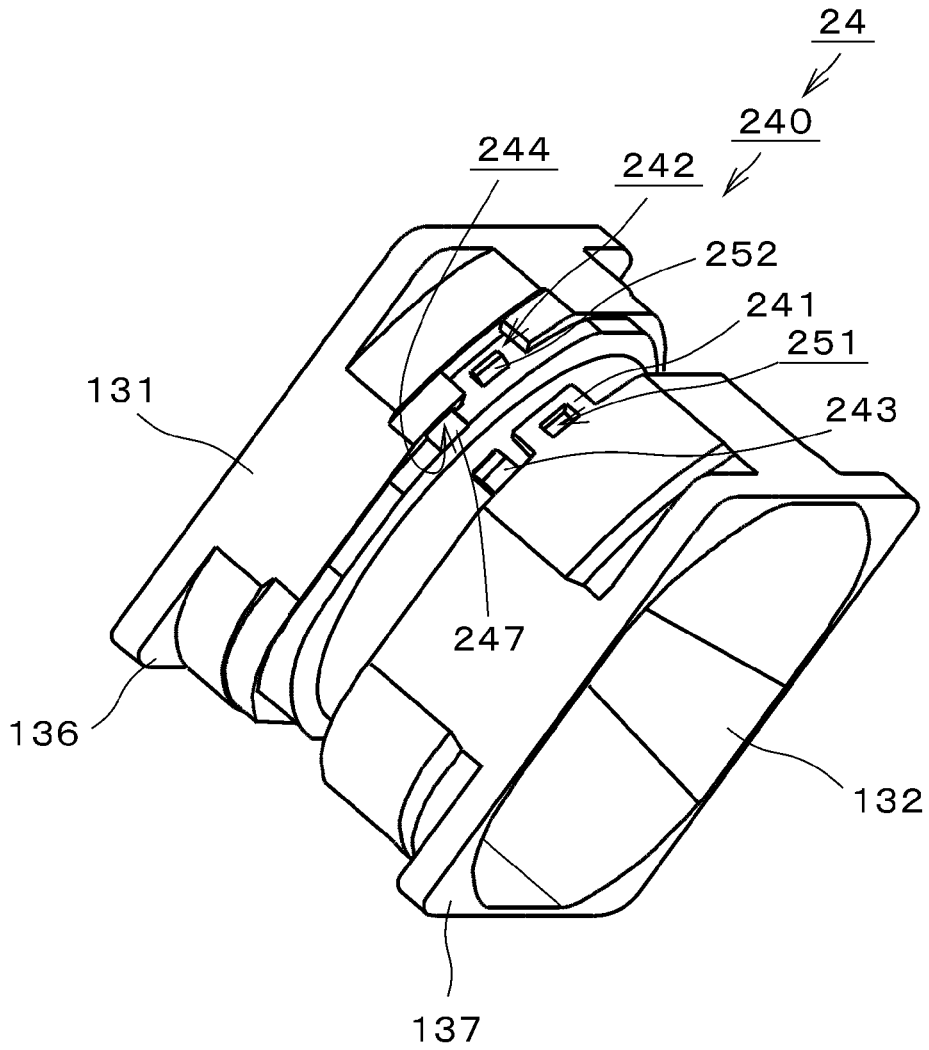
FIG. 3 is a perspective view of an upper housing portion and a lower housing portion according to a preferred embodiment of the present invention.
Figure 4:
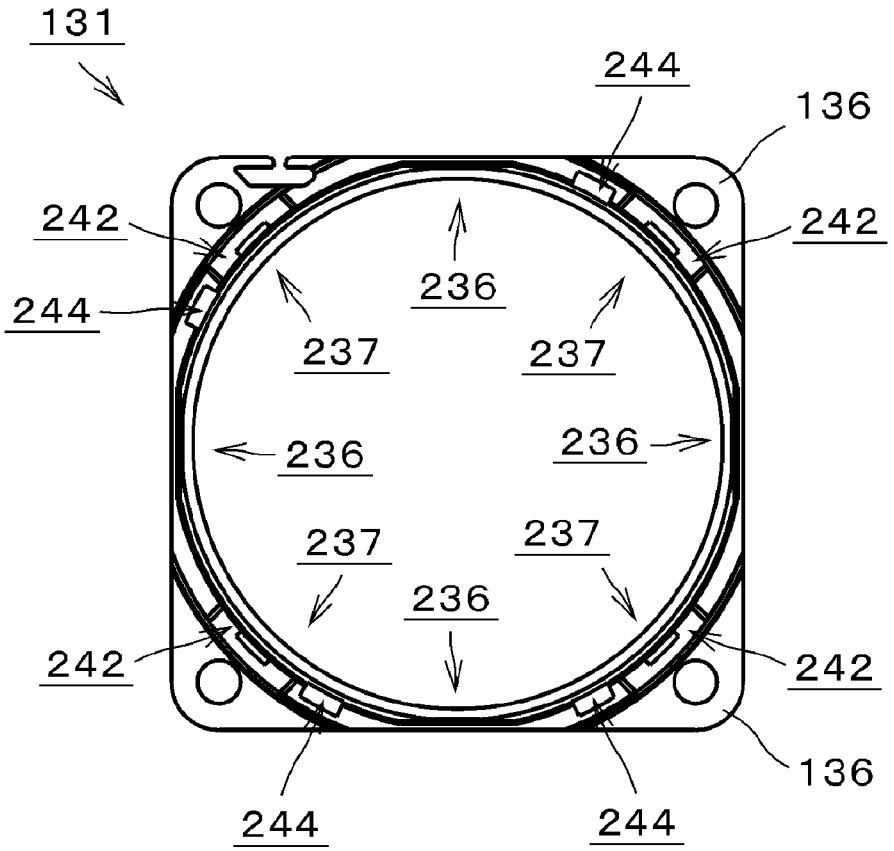
FIG. 4 is a bottom view of the upper housing portion according to a preferred embodiment of the present invention.
Figure 5:
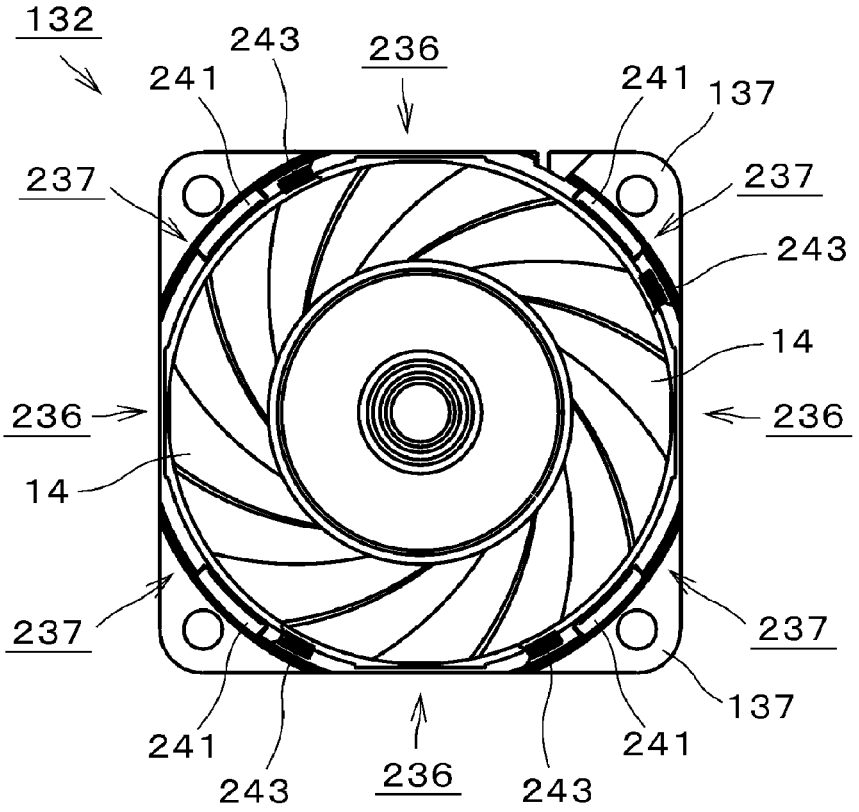
FIG. 5 is a plan view of the lower housing portion according to a preferred embodiment of the present invention.

FIG. 3 is a perspective view illustrating a situation in which the upper and lower housing portions 131 and 132 have been detached from each other in a simplified form. In FIG. 3, for the sake of clarity, the ribs 14 and the base portion 221 are not shown. FIG. 4 is a bottom view of the upper housing portion 131. FIG. 5 is a plan view of the lower housing portion 132.

Each of an upper end of the upper housing portion 131 and a lower end of the lower housing portion 132 is preferably substantially rectangular or square, for example. In other words, four upper flange portions 136 each of which is arranged to project radially outward are arranged at an upper end of the housing 13, while four lower flange portions 137 each of which is arranged to project radially outward are arranged at a lower end of the housing 13. Circumferential positions of the lower flange portions 137 are preferably arranged to coincide with circumferential positions of the upper flange portions 136. Referring to FIG. 1, each of the upper and lower flange portions 136 and 137 preferably includes a hole 138 extending in an axial direction therethrough. In FIG. 3, the holes 138 are not shown. A screw is inserted into each hole 138 when the fan 1 is attached to a predetermined location.

Referring to FIGS. 4 and 5, the housing 13 preferably includes a plurality of decreased thickness portions 236 and a plurality of increased thickness portions 237 arranged alternately in the circumferential direction. Each decreased thickness portion 236 has a radial thickness smaller than that of each increased thickness portion 237. Circumferential positions of the increased thickness portions 237 are arranged to coincide with the circumferential positions of the upper and lower flange portions 136 and 137. The outer circumferential surface 134 of the housing 13 is cylindrical in each increased thickness portion 237 and flat in each decreased thickness portion 236.

The housing 13 further includes a fastening structure 24. The fastening structure 24 is preferably includes four component fastening structures 240. In FIG. 3, only one of the component fastening structures 240 is shown. The lower housing portion 132 preferably includes a plurality of projecting portions 241 as portions of the fastening structure 24. Each projecting portion 241 is arranged to extend toward the upper housing portion 131. The projecting portions 241 are preferably arranged in the increased thickness portions 237. The upper housing portion 131 includes a plurality of recessed portions 242 as portions of the fastening structure 24. Each of the projecting portions 241 is fitted into a separate one of the recessed portions 242 when the upper and lower housing portions 131 and 132 are fitted to each other.

The lower housing portion 132 includes a plurality of other projecting portions 243 as portions of the fastening structure 24. Hereinafter, the projecting portions 243 will be referred to as "auxiliary projecting portions". Each of the auxiliary projecting portions 243 is arranged to extend toward the upper housing portion 131. Each of the auxiliary projecting portions 243 is arranged in the vicinity of a separate one of the projecting portions 241, that is, in a separate one of the increased thickness portions 237. The upper housing portion 131 includes a plurality of other recessed portions 244 as portions of the fastening structure 24. Hereinafter, the recessed portions 244 will be referred to as "auxiliary recessed portions". Each of the auxiliary projecting portions 243 is inserted into a separate one of the auxiliary recessed portions 244.

Circumferential positions of the component fastening structures 240 are preferably arranged to coincide with the circumferential positions of the upper and lower flange portions 136 and 137. In other words, the component fastening structures 240 are arranged in the increased thickness portions 237. The fastening structure 24 can thereby be easily provided while reducing an increase in the radial dimension of the housing 13.

On a bottom left corner of FIG. 5, one of the auxiliary projecting portions 243 is arranged adjacent to and on a counterclockwise side of a corresponding one of the projecting portions 241. Each of the other three auxiliary projecting portions 243 is arranged adjacent to and on a clockwise side of a corresponding one of the projecting portions 241. A right-hand side of FIG. 4 corresponds to a left-hand side of FIG. 5. Therefore, on a bottom right corner of FIG. 4, one of the auxiliary recessed portions 244 is arranged adjacent to and on a clockwise side of a corresponding one of the recessed portions 242. Each of the other three auxiliary recessed portions 244 is arranged adjacent to and on a counterclockwise side of a corresponding one of the recessed portions 242.

Relative positions of the projecting portion 241 and the auxiliary projecting portion 243 in one of the component fastening structures 240 are arranged to be different from those in the other component fastening structures 240. This arrangement allows the lower housing portion 132 to be fitted to the upper housing portion 131 only when the lower housing portion 132 is placed in a single predetermined circumferential position relative to the upper housing portion 131. Therefore, the above arrangement according to the present preferred embodiment contributes to preventing a failure in fitting the upper and lower housing portions 131 and 132 to each other.

Figure 6:
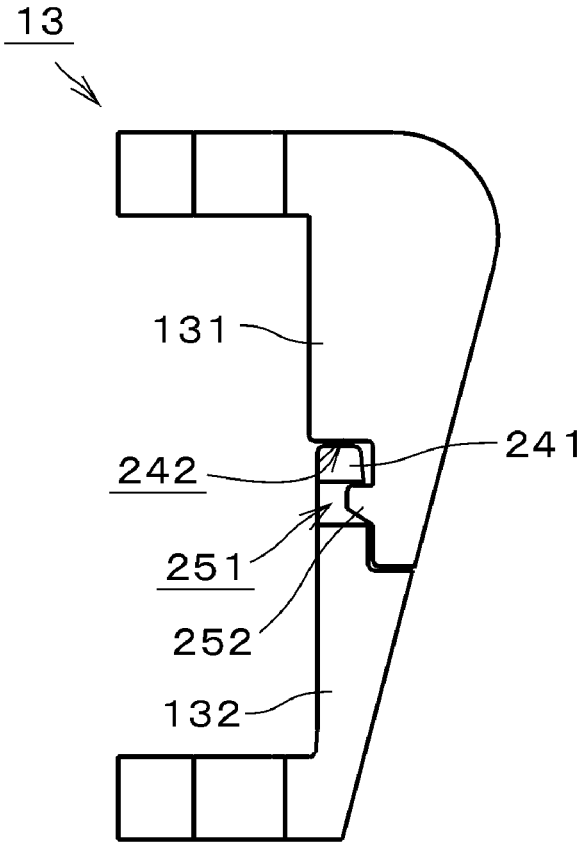
FIG. 6 is a cross-sectional view of a portion of the housing according to a preferred embodiment of the present invention.

FIG. 6 is a vertical cross-sectional view of a portion of the housing 13, illustrating how each projecting portion 241 and a corresponding one of the recessed portions 242 are engaged with each other. Referring to FIGS. 3 and 6, the projecting portion 241 preferably includes a hole 251 defined in a center thereof, the hole 251 extending in a radial direction through the projecting portion 241. The recessed portion 242 is preferably arranged to extend upward from a lower end of the upper housing portion 131. The recessed portion 242 preferably is groove-shaped, and is recessed radially inward from an outer circumferential surface of the upper housing portion 131. A minute projection 252 arranged to project radially outward is arranged in a center of the recessed portion 242.

Figure 7:
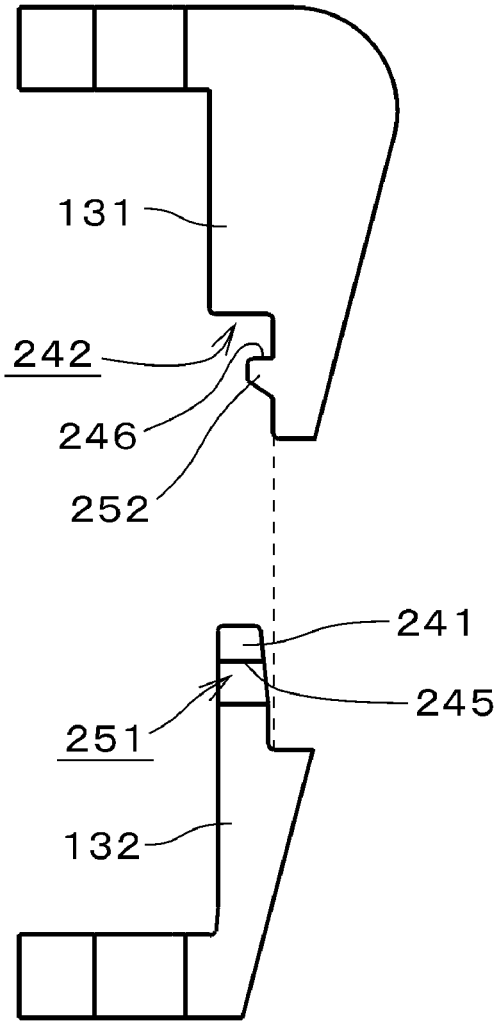
FIG. 7 is a cross-sectional view of portions of the upper housing portion and the lower housing portion according to a preferred embodiment of the present invention.

Referring to FIG. 7, when the upper and lower housing portions 131 and 132, which are detached from each other, are brought closer to each other in the axial direction, each of the projecting portions 241 is brought into contact with a corresponding one of the minute projections 252 of the upper housing portion 131. The projecting portion 241 is thereby once elastically deformed radially outward. The minute projection 252 is thereafter fitted into the hole 251 of the projecting portion 241, so that the projecting portion 241 returns to a radially inward position. As a result, each of the projecting portions 241 is brought into axial engagement with a corresponding one of the recessed portions 242.

More specifically, each projecting portion 241 includes a first contact surface 245, which is a surface on an upper side of the hole 251. Each recessed portion 242 includes a second contact surface 246, which is an upper surface of the minute projection 252. A direction normal to the first contact surface 245 is preferably oriented away from the upper housing portion 131. A direction normal to the second contact surface 246 is preferably oriented away from the lower housing portion 132. The first contact surface 245 of each projecting portion 241 is preferably in contact with the second contact surface 246 of the corresponding recessed portion 242 when each projecting portion 241 and the corresponding recessed portion 242 are engaged with each other. The upper and lower housing portions 131 and 132 are thereby fitted to each other in the axial direction. Needless to say, the upper and lower housing portions 131 and 132 are preferably fitted to each other in the circumferential direction as well, as a result of the minute projection 252 of each recessed portion 242 being fitted into the hole 251 of the corresponding projecting portion 241.

Figure 8:
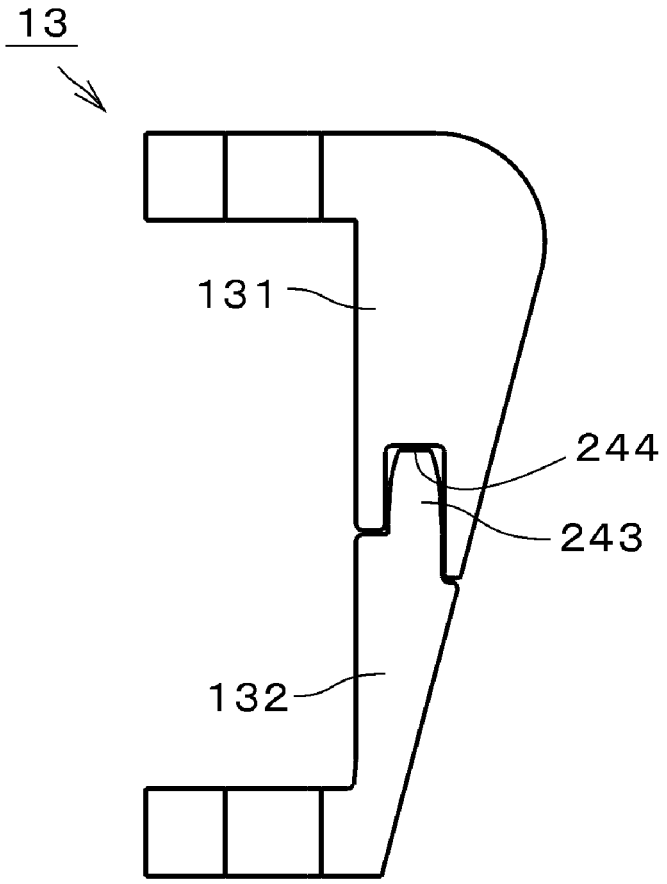
FIG. 8 is a cross-sectional view of a portion of the housing according to a preferred embodiment of the present invention.

FIG. 8 is a vertical cross-sectional view of a portion of the housing 13, illustrating how each auxiliary projecting portion 243 and a corresponding one of the auxiliary recessed portions 244 are engaged with each other. Referring to FIGS. 3 and 8, each auxiliary recessed portion 244 is preferably a hole portion including a bottom and arranged to extend upward from the lower end of the upper housing portion 131. Therefore, relative circumferential positions of the upper and lower housing portions 131 and 132 are settled when each auxiliary projecting portion 243 is inserted into a corresponding one of the auxiliary recessed portions 244.

As described above, a so-called snap-fit structure is preferably adopted in the housing 13. That is, each projecting portion 241 is temporarily bent radially outward when the upper and lower housing portions 131 and 132 are fitted to each other. Therefore, when a force or forces acting in such a direction or directions that the upper and lower housing portions 131 and 132 will be detached from each other is applied to one or both of the upper and lower housing portions 131 and 132, a certain force which bends each projecting portion 241 radially outward is applied to the projecting portion 241. However, the auxiliary projecting portion 243, which is arranged in the vicinity of the projecting portion 241, has been inserted into a corresponding one of the auxiliary recessed portions 244, each of which is in the shape of a hole. Therefore, the auxiliary projecting portion 243 is not able to bend radially outward together with the projecting portion 241. The auxiliary projecting portion 243 thus contributes to preventing the projecting portion 241 from bending.

As a result, even when the snap-fit structure is adopted, an improvement in the strength with which the upper and lower housing portions 131 and 132 are fitted to each other, that is, shock resistance and a load capacity against a radially acting force, is preferably achieved. In addition, there is no need to increase the thickness of the housing in order to improve the fitting strength. This preferably prevents an effect of a change in outside dimensions of the housing on attachment of the housing to a target device. Examples of such an effect include a limitation on applications of the fan, and a need to change the design of the target device. Moreover, the auxiliary projecting portions 243 and the auxiliary recessed portions 244 contribute to preventing an amplification of a vibration of the fastening structure and a damage of the fastening structure.

The above-described beneficial effects can be obtained without each auxiliary recessed portion 244 being in the shape of a hole, as long as a radially outer surface of each auxiliary projecting portion 243 is arranged to make contact with a corresponding one of the auxiliary recessed portions 244. For example, each auxiliary recessed portion 244 may be defined in an inner circumference of the upper housing portion 131, and be arranged in the shape of a groove and arranged to extend upward from the lower end of the upper housing portion 131.

When the upper and lower housing portions 131 and 132 are brought closer to each other, each auxiliary projecting portion 243 is preferably inserted into a groove 247 defined in the outer circumferential surface of the upper housing portion 131 as illustrated in FIG. 3 before a tip of each projecting portion 241 enters into a corresponding one of the recessed portions 242. Each auxiliary projecting portion 243 thus preferably functions as a guide portion to help the fitting of the upper and lower housing portions 131 and 132 to each other.

As described above, the radial thickness of the housing 13 gradually decreases with decreasing height. If a recessed portion is defined in a side wall portion of the housing 13, the thickness of the side wall portion of the housing 13 preferably decreases locally. Therefore, the recessed portions 242 and the auxiliary recessed portions 244 are preferably defined in the upper housing portion 131, where it is easy to secure a sufficient thickness of the housing 13. Additionally, the projecting portions 241 and the auxiliary projecting portions 243 do not require a large thickness of the housing 13. Therefore, the projecting portions 241 and the auxiliary projecting portions 243 are preferably defined in the lower housing portion 132. It is thus made easier to provide the fastening structure 24, which requires a large thickness, in the housing 13. The radial thickness of each decreased thickness portion 236 is arranged to be substantially uniform in a lower portion of the housing 13.

In addition, the projecting portions 241 and the auxiliary projecting portions 243 are arranged at different circumferential positions. Therefore, the projecting portions 241 and the auxiliary projecting portions 243 do not interfere with each other in the radial direction. This makes it possible to achieve a reduction in the thickness of the housing 13 at the boundary 135.

As shown in the right-hand side of FIG. 1, the boundary 135 between the upper and lower housing portions 131 and 132 includes a radial shoulder 139. In other words, the boundary 135 is preferably not flat in the radial direction, and includes a shoulder-shaped portion which increases or decreases in height as it extends radially outward. In FIG. 1, each of a lower surface of the upper housing portion 131 and an upper surface of the lower housing portion 132 is arranged to extend radially outward from the inner circumferential surface 133 of the housing 13, and to extend upward and then radially outward to reach the outer circumferential surface 134. When the boundary 135 has such a labyrinth structure, the likelihood that air or wind (i.e., the air flowing through the housing 13) will leak out of the wind channel through the boundary 135 is reduced. At the labyrinth structure, an inner circumferential portion of the upper housing portion 131 is arranged to extend downward in order to reduce disturbed air currents.

In the housing 13, a radially outer surface of each of the projecting portions 241 defines a portion of the outer circumferential surface 134 of the housing 13. In other words, the distance from the radially outer surface of each projecting portion 241 to the central axis J1 is preferably equal or substantially equal to the distance from the central axis J1 to the outer circumferential surface 134 of the housing 13. Meanwhile, the radially outer surface of each of the auxiliary projecting portions 243 is arranged radially inward of the outer circumferential surface 134 of the housing 13. Thus, when the screws are inserted into the holes 138 of the upper and lower flange portions 136 and 137, it is possible to prevent the screws from interfering with the component fastening structures 240, which thus facilitates an operation of installing the fan 1. Moreover, since it is possible to increase the outside diameter of the housing 13 insofar as the housing 13 does not make contact with the screws, it is possible to achieve an increase in the inside diameter of the housing 13.

Note that prevention of interference between the component fastening structures 240 and the screws can be achieved when the radially outer surface of each of the projecting portions 241 either defines a portion of the outer circumferential surface of the housing 13 or is positioned radially inward of the outer circumferential surface of the housing 13, and, in addition, the radially outer surface of each of the auxiliary projecting portions 243 either defines a portion of the outer circumferential surface of the housing 13 or is positioned radially inward of the outer circumferential surface of the housing 13.

In FIG. 1, the inclination of the inner circumferential surface 133 of the housing 13 is illustrated in an exaggerated manner for the sake of illustration. Referring to FIG. 5, the ribs 14 preferably are a plurality of stationary vanes each of which is in the shape of a curved plate. Hereinafter, the ribs 14 will be referred to as the "stationary vanes".

Figure 9A:
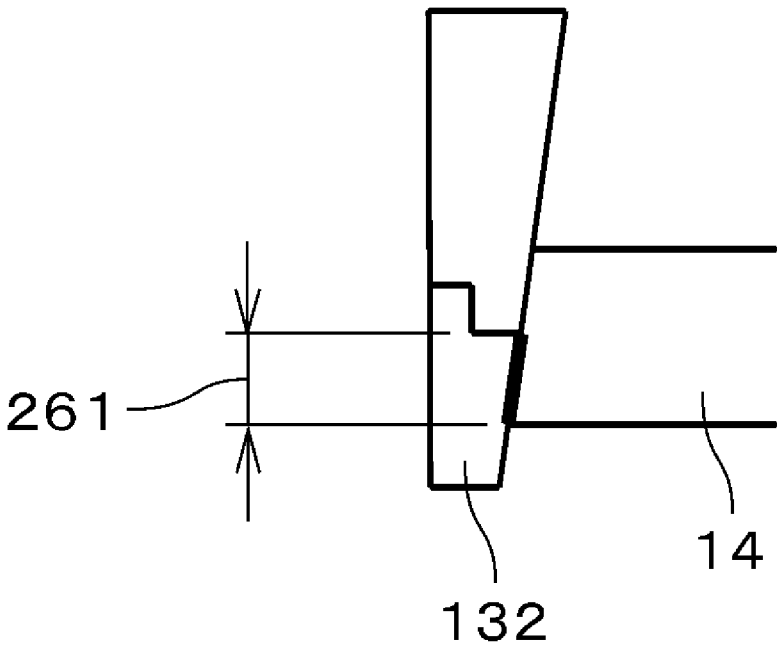
FIG. 9A is a diagram illustrating how the lower housing portion and a stationary vane are joined to each other according to a preferred embodiment of the present invention.
Figure 9B:
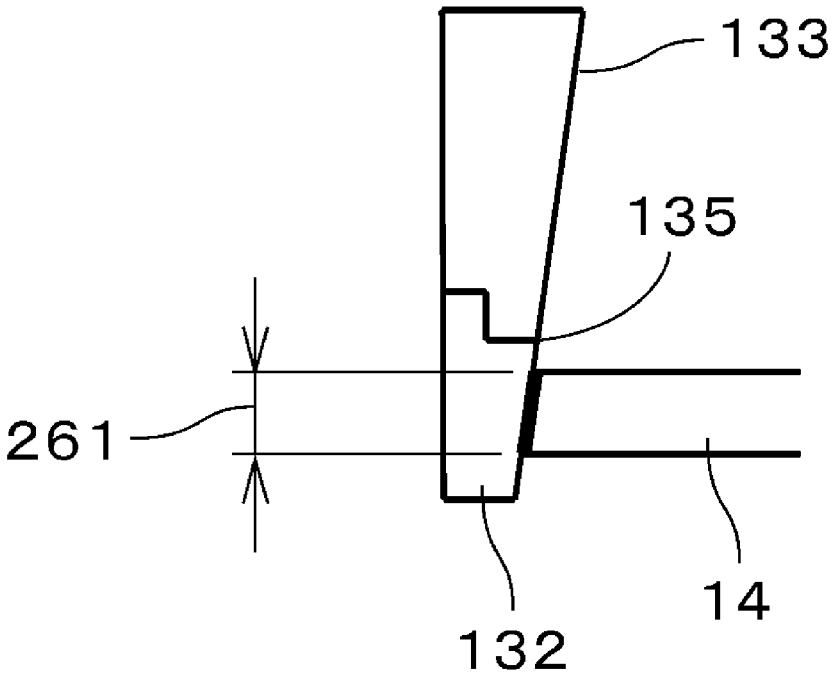
FIG. 9B is a diagram illustrating how the lower housing portion and the stationary vane are joined to each other according to a preferred embodiment of the present invention.

FIGS. 9A and 9B are diagrams for explaining a desirable manner in which the lower housing portion 132 and each stationary vane 14 are joined to each other. The focus will now switch to an axial joint range 261 over which the lower housing portion 132 and each of the stationary vanes 14 are joined to each other. In the case of FIG. 9A, an upper end of the joint range 261 preferably coincides with an upper end of the lower housing portion 132. That is, the distance between the upper end of the joint range 261 and the upper end of the lower housing portion 132 is preferably zero. Therefore, the distance between the upper end of the joint range 261 and the upper end of the lower housing portion 132 is smaller than the distance between a lower end of the joint range 261 and the lower end of the lower housing portion 132. Note that it is assumed here that the upper end of the lower housing portion 132 refers to an upper end of the lower housing portion 132 in the inner circumferential surface 133 of the housing 13.

In the case of FIG. 9B, the upper end of the joint range 261 preferably coincides with an upper end of the stationary vane 14. That is, the upper end of the joint range 261 and the upper end of the lower housing portion 132 are away from each other. Also in this case, the distance between the upper end of the joint range 261 and the upper end of the lower housing portion 132 is smaller than the distance between the lower end of the joint range 261 and the lower end of the lower housing portion 132. Note that the distance between the lower end of the joint range 261 and the lower end of the lower housing portion 132 is preferably zero when the lower end of the joint range 261 coincides with the lower end of the lower housing portion 132.

When the distance between the upper end of the joint range 261 and the upper end of the lower housing portion 132 is smaller than the distance between the lower end of the joint range 261 and the lower end of the lower housing portion 132, each stationary vane 14 is joined to an axially upper portion of the lower housing portion 132. As a result, a reduction in an unwanted extent of an inner circumferential surface of the lower housing portion 132 on an upper side of each stationary vane 14 is achieved.

In the case of FIG. 9B, the upper end of the lower housing portion 132, that is, the boundary 135 between the upper and lower housing portions 131 and 132, is preferably arranged axially between a lower end of each of the blades 111 and the upper end of each of the stationary vanes 14. To be precise, it is assumed here that the boundary 135 refers to a boundary between the upper and lower housing portions 131 and 132 in the inner circumferential surface 133, and that the lower end of each of the blades 111 refers to a lower end of the radially outer edge 11 of the blade 111. In this case, it is possible to easily attach the upper housing portion 131 to the lower housing portion 132 without interference between the impeller 11 and the upper housing portion 131 when the upper housing portion 131 is attached to the lower housing portion 132, while a reduction in an unwanted extent of the lower housing portion 132 is achieved.

Figure 10:
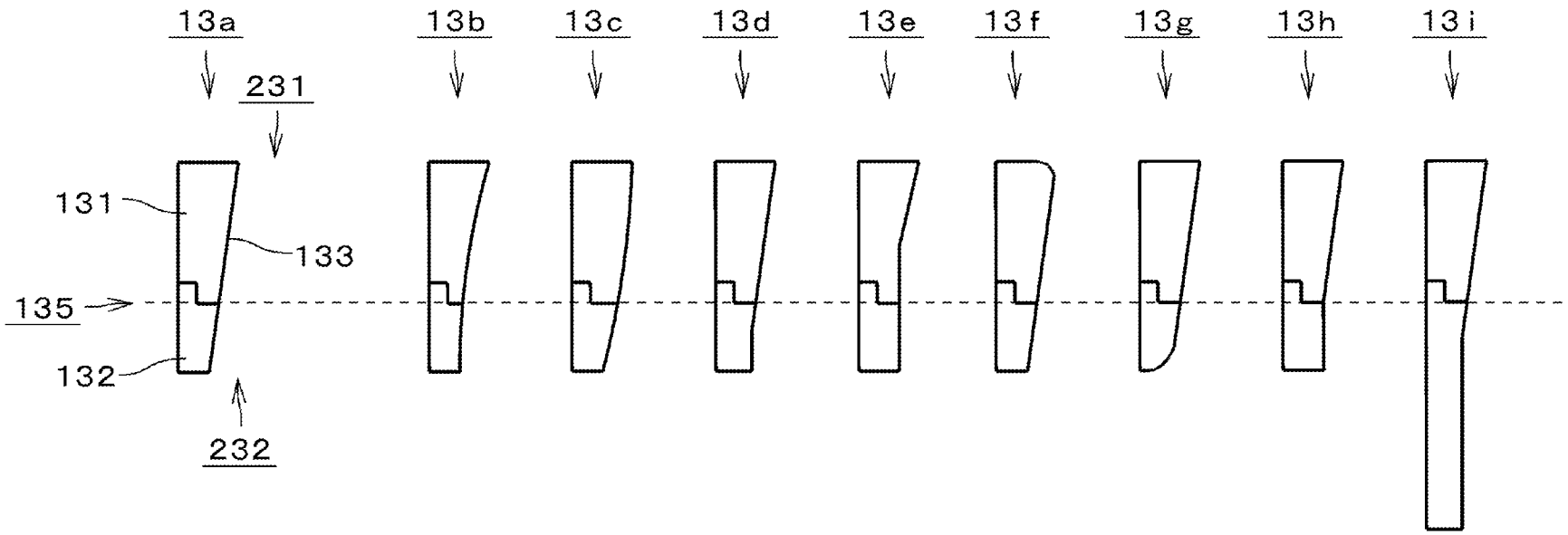
FIG. 10 is a diagram illustrating various examples of a section of a portion of the housing according to various preferred embodiments of the present invention.

FIG. 10 is a diagram illustrating various examples of a section of a portion of the housing 13. The housing 13 is denoted by reference characters "13*a*" through "13*i*". The axial position of the boundary 135 between the upper and lower housing portions 131 and 132 is indicated by a broken line.

A section of the inner circumferential surface 133 of a housing 13*a* taken along a plane including the central axis J1 is preferably a straight line which becomes progressively more distant from the central axis J1 with decreasing height between the air inlet 231 and the air outlet 232. Hereinafter, a section of the inner circumferential surface 133 taken along the plane including the central axis J1 will be referred to simply as a "section of the inner circumferential surface 133". A portion of a section of the inner circumferential surface 133 of a housing 13*b*, the portion extending between the air inlet 231 and the air outlet 232, preferably has an angle of inclination with respect to the central axis J1 becoming progressively smaller with decreasing height. This arrangement contributes to expanding the wind channel. A portion of a section of the inner circumferential surface 133 of a housing 13*c*, the portion extending between the air inlet 231 and the air outlet 232, preferably has an angle of inclination with respect to the central axis J1 becoming progressively larger with decreasing height.

A portion of a section of the inner circumferential surface 133 of a housing 13*d*, the portion extending from the air inlet 231 to an upper portion of the lower housing portion 132, is preferably a straight line which becomes progressively more distant from the central axis J1 with decreasing height. A portion of the section of the inner circumferential surface 133 of the housing 13*d*, the portion extending in a lower portion of the lower housing portion 132, is preferably a straight line parallel or substantially parallel to the central axis J1. A portion of a section of the inner circumferential surface 133 of a housing 13*e*, the portion extending from the air inlet 231 to a lower portion of the upper housing portion 131, is preferably a straight line which becomes progressively more distant from the central axis J1 with decreasing height. A portion of the section of the inner circumferential surface 133 of the housing 13*e*, the portion extending downward from the lower portion of the upper housing portion 131, is preferably a straight line parallel or substantially parallel to the central axis J1.

A housing 13*f* is preferably identical to the housing 13*a* except that a portion of a section of the inner circumferential surface 133 of the housing 13*f*, the portion being near the air inlet 231, is preferably a smooth curved line. A housing 13*g* is preferably identical to the housing 13*a* except that a portion of a section of the inner circumferential surface 133 of the housing 13*g*, the portion being near the air outlet 232, is a smooth curved line. Note that at least one of the air inlet 231 and the air outlet 232 may be arranged to also have a smooth shape in the other examples of the housing 13.

A portion of a section of the inner circumferential surface 133 of a housing 13*h*, the portion extending from the air inlet 231 to the boundary 135, is preferably a straight line which becomes progressively more distant from the central axis J1 with decreasing height. A portion of the section of the inner circumferential surface 133 of the housing 13*h*, the portion extending downward from the boundary 135, is preferably a straight line parallel or substantially parallel to the central axis J1. A housing 13*i* is preferably identical to the housing 13*d* except that a lower portion of the housing 13*i* is elongated downward.

In the case where the section of the inner circumferential surface 133 includes, between the air inlet 231 and the air outlet 232, a straight line which becomes progressively more distant from the central axis J1 with decreasing height, as is the case with each of the housings 13*a* and 13*d* to 13*i*, it is easy to design the housing 13. A portion of the section of the inner circumferential surface 133, which is parallel or substantially parallel to the central axis J1, need not necessarily be arranged at a lower end. In general terms, the diameter of the inner circumferential surface 133 of the housing 13 is arranged to increase with decreasing height between the air inlet 231 and an axial middle portion of the radially outer edge of each of the blades 111. In addition, below the axial middle portion of the radially outer edge of each blade 111, the diameter of the inner circumferential surface 133 is preferably arranged to increase with decreasing height, to be uniform, or to increase with decreasing height while being uniform over an area or areas. That is, the inner circumferential surface 133 preferably does not include a portion whose diameter decreases with decreasing height.

Therefore, the radial thickness of the housing 13 is not necessarily required to be arranged to gradually decrease with decreasing height. Note, however, that the radial thickness of the housing 13 is preferably arranged to decrease from the air inlet 231 toward the air outlet 232, or to decrease from the air inlet 231 toward the air outlet 232 while being uniform over an area or areas. A portion of the housing 13 which has a uniform thickness is preferably arranged in the lower portion of the housing 13.

Note that the housing 13 may be arranged such that the upper housing portion 131 includes the projecting portions 241 while the lower housing portion 132 includes the recessed portions 242. In this case, each projecting portion 241 is arranged to extend from the upper housing portion 131 toward the lower housing portion 132. Also note that the upper housing portion 131 may include the auxiliary projecting portions 243 with the lower housing portion 132 including the auxiliary recessed portions 244. In this case, each auxiliary projecting portion 243 is arranged to extend from the upper housing portion 131 toward the lower housing portion 132. Therefore, the projecting portions 241 and the auxiliary projecting portions 243 may be included in the lower housing portion 132 and the upper housing portion 131, respectively, for example.

Figure 15:
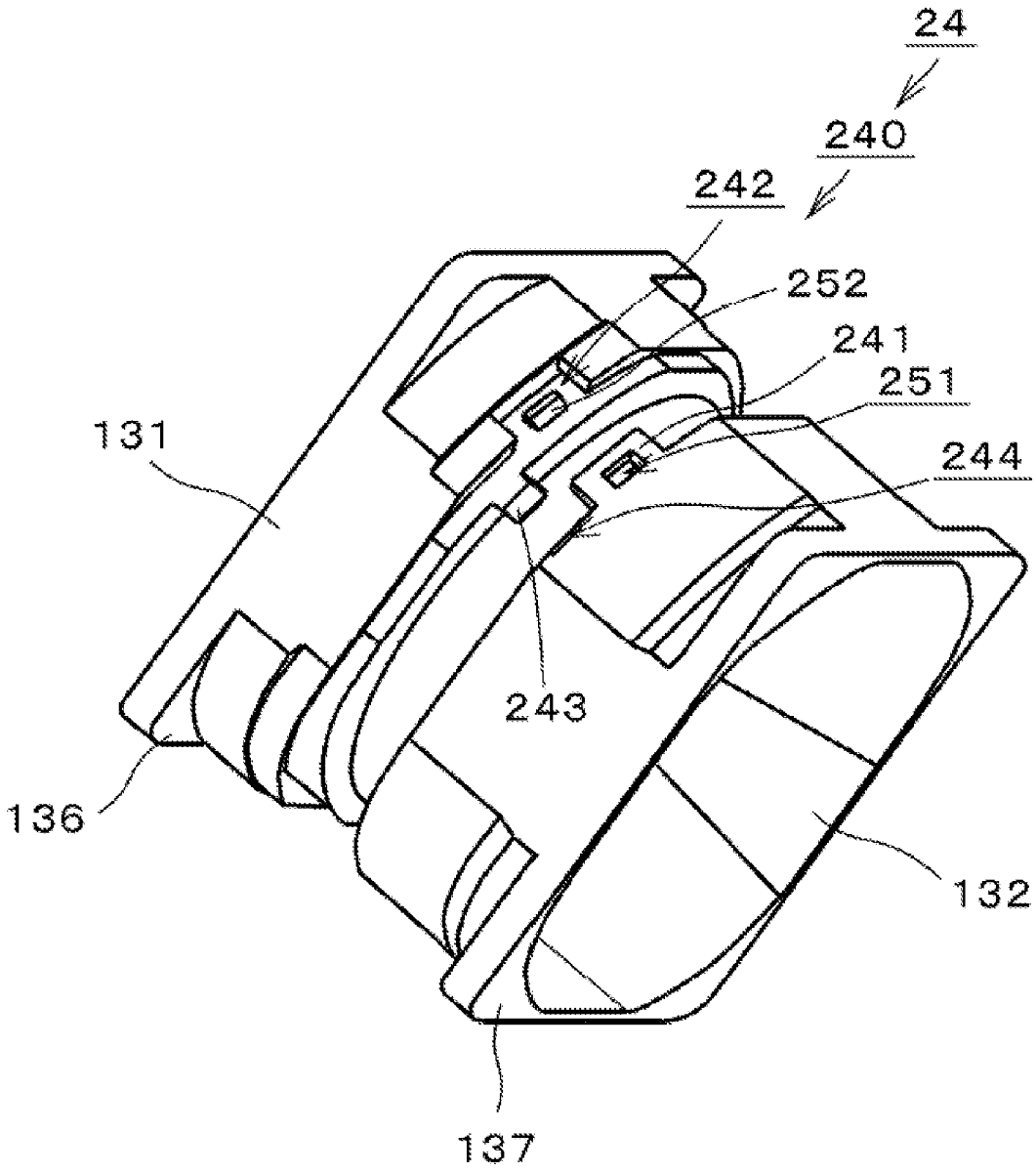
FIG. 15 is a perspective view of an upper housing portion and a lower housing portion according to a preferred embodiment of the present invention.
Figure 16:
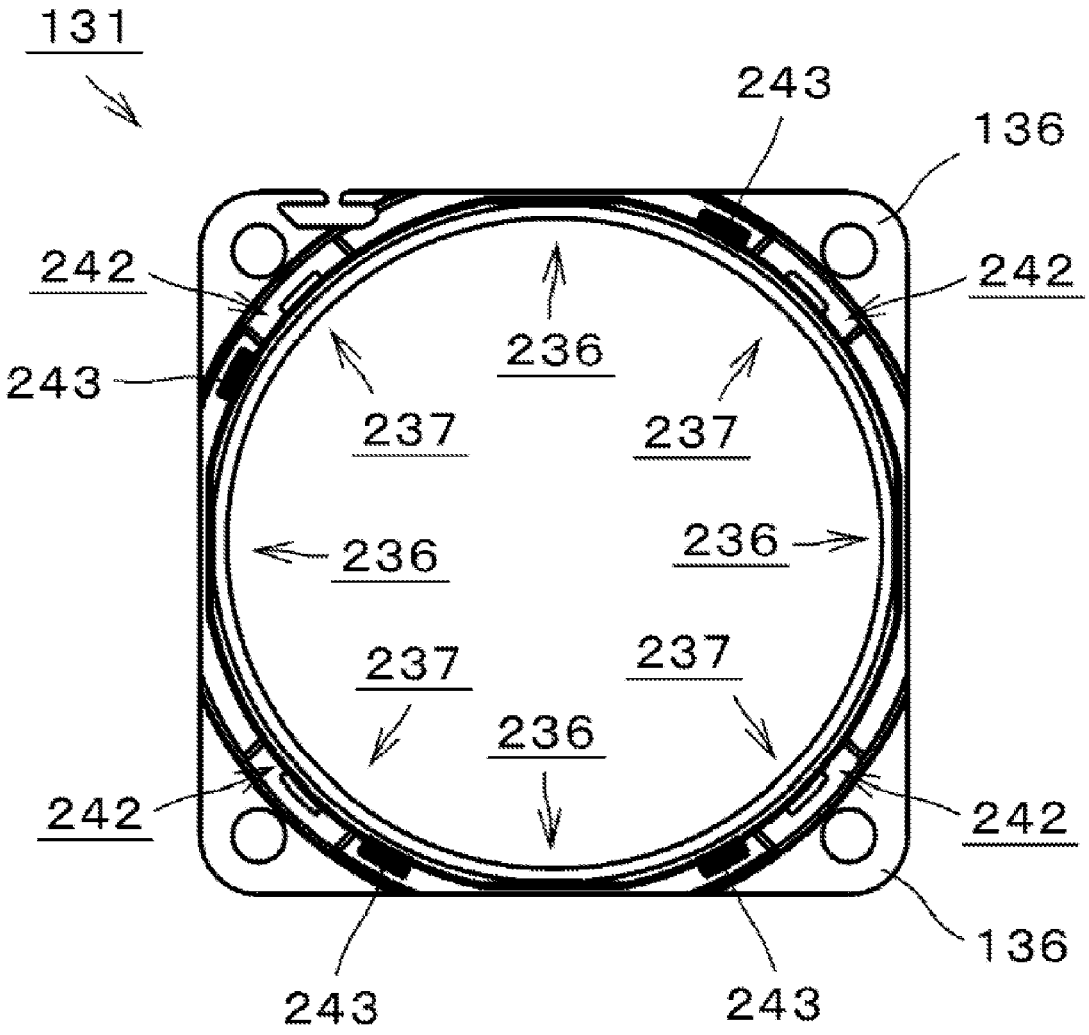
FIG. 16 is a bottom view of the upper housing portion according to a preferred embodiment of the present invention.
Figure 17:
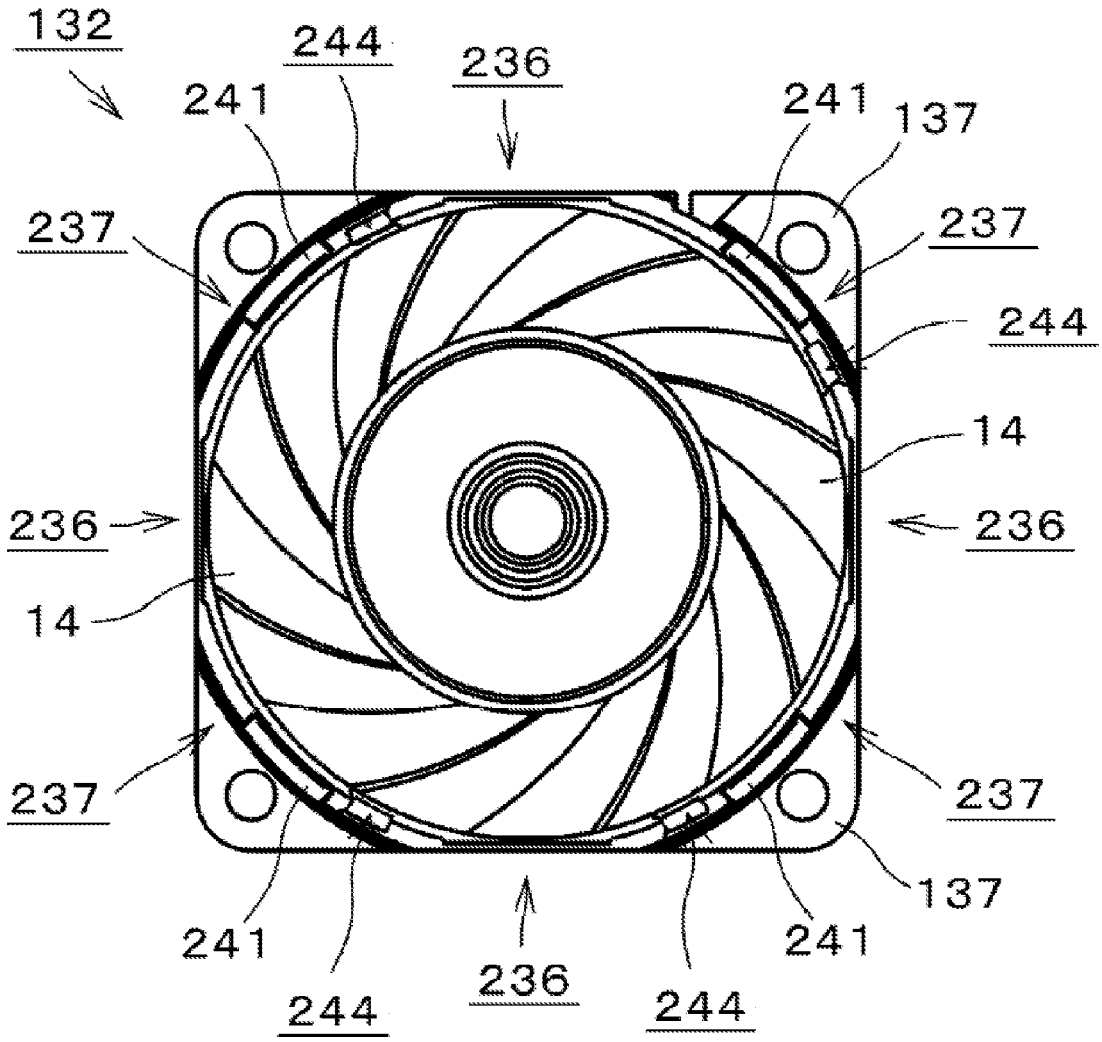
FIG. 17 is a plan view of the lower housing portion according to a preferred embodiment of the present invention.

To express the upper and lower housing portions 131 and 132 in general terms as "housing segments", one of the housing segments (hereinafter referred to as a "first housing segment") preferably includes the plurality of projecting portions 241 each of which is arranged to extend toward the other housing segment (hereinafter referred to as a "second housing segment"), while the second housing segment preferably includes the plurality of recessed portions 242 each of which is arranged to have a separate one of the projecting portions 241 fitted thereinto. In addition, the first housing segment includes the plurality of auxiliary projecting portions 243, each of which is arranged to extend toward the second housing segment in the vicinity of a separate one of the projecting portions 241. Also, the second housing segment includes the plurality of auxiliary recessed portions 244, each of which is arranged to have a separate one of the auxiliary projecting portions 243 fitted thereinto. Alternatively, the second housing segment may include the plurality of auxiliary projecting portions 243, each of which is arranged to extend toward the first housing segment in the vicinity of a separate one of the recessed portions 242, with the first housing segment including the plurality of auxiliary recessed portions 244, each of which is arranged to have a separate one of the auxiliary projecting portions 243 fitted thereinto, as shown in FIGS. 15-17.

Note that the projecting portions 241 and the recessed portions 242 may be arranged in an inner circumference of the housing 13. In this case, when the upper and lower housing portions 131 and 132, which are detached from each other, are brought closer to each other in the axial direction, each of the projecting portions 241 is preferably brought into contact with an opposing one of the upper and lower housing portions 131 and 132, is thereby once elastically deformed radially inward, and then returns radially outward, so that the projecting portion 241 is brought into axial engagement with a corresponding one of the recessed portions 242.

Figure 11:
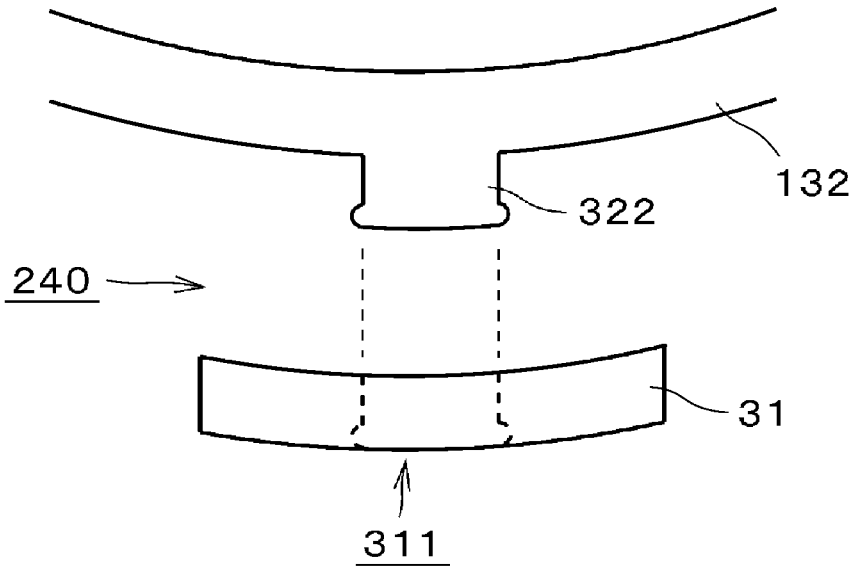
FIG. 11 is a diagram illustrating a component fastening structure according to a modification of a preferred embodiment of the present invention.
Figure 12:
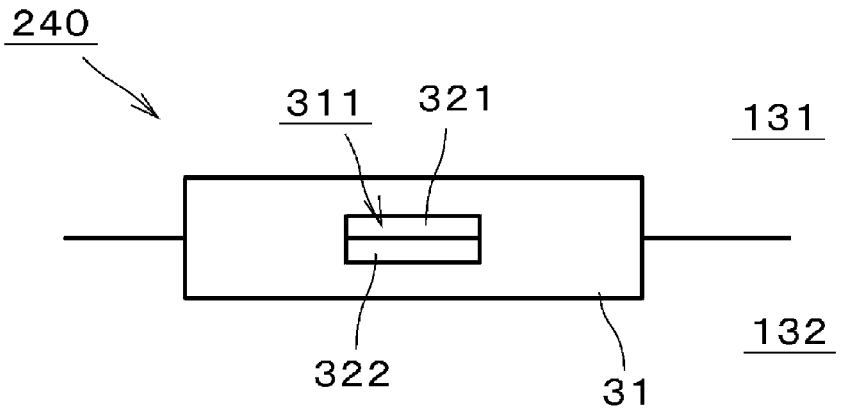
FIG. 12 is a diagram illustrating the component fastening structure according to a modification of a preferred embodiment of the present invention.

FIG. 11 is a diagram illustrating a component fastening structure 240 according to another preferred embodiment of the present invention, and a plan view illustrating an upper end of a lower housing portion 132 and a clip 31. FIG. 12 is a diagram illustrating the component fastening structure 240 when viewed from radially outside. The component fastening structure 240 preferably includes a projecting portion 322 arranged to project radially outward from the upper end of the lower housing portion 132. The component fastening structure 240 further preferably includes a projecting portion 321 arranged to project radially outward from a lower end of an upper housing portion 131. The clip 31 preferably includes a hole 311 extending therethrough in a center thereof. A tip of each of the projecting portions 321 and 322 is arranged to spread slightly in the circumferential direction.

The projecting portions 321 and 322 are placed one upon the other in the axial direction, and these projecting portions 321 and 322 are inserted into the hole 311 of the clip 31, whereby the upper and lower housing portions 131 and 132 are fitted to each other. The component fastening structure 240 is preferably provided in each of increased thickness portions 237 in a manner similar to that illustrated in FIGS. 4 and 5. Thus, an improvement in rigidity of a fastening structure 24 is achieved, while the fastening structure 24 can be provided easily.

Figure 13:
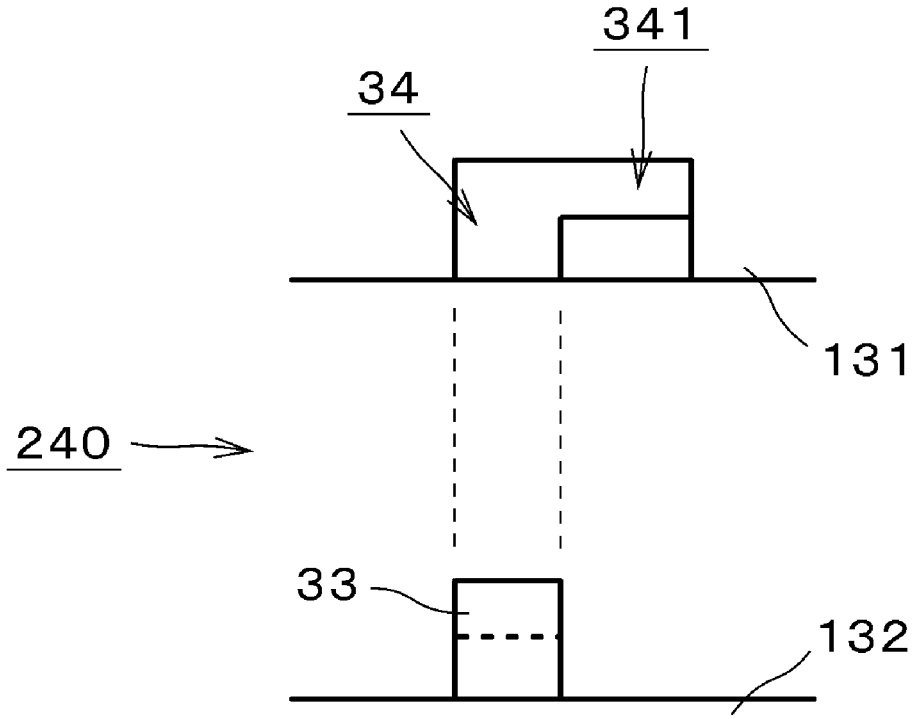
FIG. 13 is a diagram illustrating a component fastening structure according to a modification of a preferred embodiment of the present invention.
Figure 14:
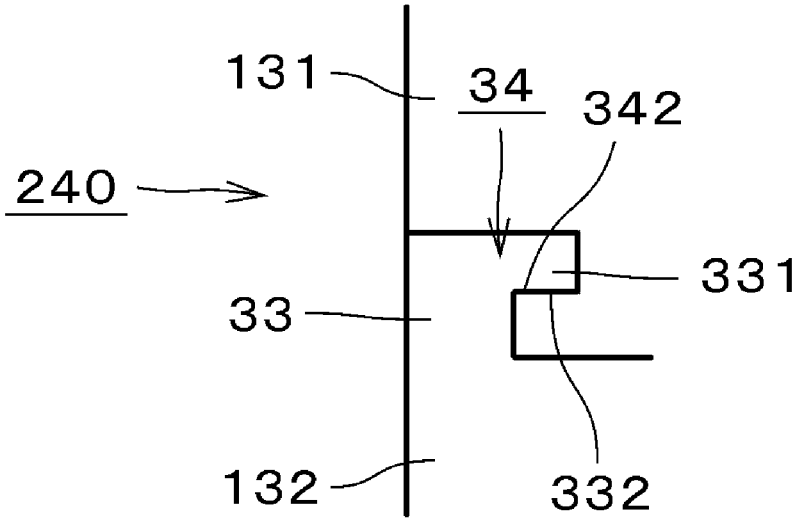
FIG. 14 is a diagram illustrating the component fastening structure according to a modification of a preferred embodiment of the present invention.

FIG. 13 is a diagram illustrating a component fastening structure 240 according to another preferred embodiment of the present invention, and a diagram illustrating upper and lower housing portions 131 and 132 as detached from each other when viewed from radially outside. FIG. 14 is a vertical cross-sectional view of the component fastening structure 240. The component fastening structure 240 is arranged in each of increased thickness portions 237. A fastening structure 24 can thus be provided easily while reducing an increase in the radial dimension of a housing 13.

In the component fastening structure 240, a projecting portion 33 arranged to project toward the upper housing portion 131 is arranged in an upper end of the lower housing portion 132, while a recessed portion 34 is arranged in a lower portion of the upper housing portion 131. The recessed portion 34 is arranged to extend upward from a lower end of the upper housing portion 131, and includes a portion 341 which further extends to the right in FIG. 13. Referring to FIG. 14, a tip of the projecting portion 33 includes a protruding portion 331 arranged to protrude radially inward.

The projecting portion 33 is preferably inserted into the recessed portion 34, and the projecting portion 33 is then slid to the right in FIG. 13 along the portion 341, so that the protruding portion 331 and the recessed portion 34 are brought into axial engagement with each other as illustrated in FIG. 14. That is, the projecting portion 33 preferably includes a lower surface of the protruding portion 331 as a first contact surface 332, while the portion 341 of the recessed portion 34 preferably includes, as a second contact surface 342, a surface whose normal is oriented upward. The first and second contact surfaces 332 and 342 are brought into contact with each other. Note that, to be precise, a contact between the upper end of the lower housing portion 132 and the lower end of the upper housing portion 131 is also used to fit the upper and lower housing portions 131 and 132 to each other.

According to the structure of the component fastening structure 240 illustrated in FIGS. 6 and 7, and the structure of the component fastening structure 240 illustrated in FIGS. 13 and 14, in general terms, each projecting portion includes the first contact surface, each recessed portion includes the second contact surface, the normal to the first contact surface is oriented in a direction away from the housing segment in which the recessed portions are provided, and the first and second contact surfaces are brought into contact with each other, such that the fitting of the upper and lower housing portions 131 and 132 to each other is accomplished. The fitting of the upper and lower housing portions 131 and 132 to each other requires a contact between the upper end of the lower housing portion 132 and the lower end of the upper housing portion 131. Therefore, to be precise, the plurality of projecting portions and the plurality of recessed portions are provided as at least portions of the fastening structure.

While preferred embodiments of the present invention have been described above, it is to be understood that the present invention is not limited to the above-described preferred embodiments.

Other structures may be adopted as the fastening structure 24. For example, each projecting portion 241 may include, at the tip thereof, a protruding portion arranged to protrude radially inward, with each recessed portion 242 including a minute recessed portion arranged to be recessed radially inward. Moreover, the auxiliary projecting portions and the auxiliary recessed portions may be additionally provided in each of the structure illustrated in FIGS. 11 and 12 and the structure illustrated in FIGS. 13 and 14.

A variety of other structures may be adopted as the structure designed to permit the lower housing portion 132 to be fitted to the upper housing portion 131 only when the lower housing portion 132 is placed in a single predetermined circumferential position relative to the upper housing portion 131. For example, a pair of one of the auxiliary projecting portions 243 and a corresponding one of the auxiliary recessed portions 244 may be arranged to differ in shape from the other auxiliary projecting portions 243 and the other auxiliary recessed portions 244.

Each of the upper and lower ends of the housing 13 need not necessarily be rectangular or square, but may instead be circular or in other shapes. The labyrinth structure defined between the upper and lower housing portions 131 and 132 may be modified in a variety of manners. For example, a plurality of radial shoulders may be arranged at the boundary 135. Each rib 14 may be arranged in the shape of a simple bar.

Features of the above-described preferred embodiments and the modifications thereof may be combined appropriately as long as no conflict arises.

The present invention is applicable to fans used for a variety of applications.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A fan comprising:

an impeller;

a motor portion arranged to rotate the impeller about a central axis extending in a vertical direction;

a housing arranged to surround an outer circumference of the impeller; and a plurality of ribs, each of which is arranged to join the motor portion and the housing to each other; wherein the impeller includes a plurality of blades arranged to extend radially outward from the central axis;

an upper opening of the housing in the vertical direction is an air inlet, while a lower opening of the housing is an air outlet;

the housing includes a plurality of decreased thickness portions and a plurality of increased thickness portions arranged alternately in a circumferential direction extending about the central axis;

a diameter of an inner circumferential surface of the housing is arranged to increase with a decreasing height in the vertical direction between the air inlet and an axial middle portion of a radially outer edge of each blade of the plurality of blades;

below the axial middle portion of the radially outer edge of each blade of the plurality of blades, the diameter of the inner circumferential surface of the housing is arranged to increase with the decreasing height in the vertical direction, to be uniform, or to increase with the decreasing height in the vertical direction while being uniform over at least one area;

a distance between the central axis and the radially outer edge of each blade of the plurality of blades is arranged to increase from the air inlet toward the air outlet;

the inner circumferential surface of the housing has a minimum radius smaller than a distance between the central axis and an outermost portion of the radially outer edge of each blade of the plurality of blades;

the housing includes:

an upper housing portion in the vertical direction; and a lower housing portion in the vertical direction arranged to be in contact with a lower portion in the vertical direction of the upper housing portion;

at a boundary between the upper and lower housing portions, the inner circumferential surface of the housing has a radius greater than the distance between the central axis and the outermost portion of the radially outer edge of each blade of the plurality of blades;

the lower housing portion, the plurality of ribs, and a base portion of the motor portion are defined by a single continuous monolithic member;

the increased thickness portions include a plurality of component fastening structures defining a fastening structure arranged to fit the upper and lower housing portions to each other;

the plurality of component fastening structures include:

a plurality of projecting portions arranged in a first housing segment and each arranged to extend toward a second housing segment, the first and second housing segments corresponding to a respective one of the upper and lower housing portions; and a plurality of recessed portions arranged in the second housing segment and each of which is arranged to have a separate one of the plurality of projecting portions fitted thereinto;

either the first housing segment includes auxiliary projecting portions, each of which is positioned in the increased thickness portions adjacent to corresponding ones of the plurality of projecting portions, the auxiliary projecting portions are arranged to extend toward the second housing segment, and the second housing segment includes auxiliary recessed portions, each of which is arranged to have a separate one of the auxiliary projecting portions fitted thereinto; or the second housing segment includes auxiliary projecting portions, each of which is positioned in the increased thickness portions adjacent to corresponding ones of the plurality of projecting portions, the auxiliary projecting portions are arranged to extend toward the first housing segment, and the first housing segment includes auxiliary recessed portions, each of which is arranged to have a separate one of the auxiliary projecting portions fitted thereinto; and in the circumferential direction extending about the central axis when viewed from an air inlet end toward an air outlet end of the central axis, one of the auxiliary projecting portions is provided on a clockwise side of a corresponding one of the plurality of projecting portions and all remaining ones of the auxiliary projecting portions are provided on counterclockwise sides of all remaining corresponding ones of the plurality of projecting portions, every one of the increased thickness portions includes one of the plurality of projecting portions and one of the auxiliary projecting portions.

2. The fan according to claim 1, wherein each projecting portion of the plurality of projecting portions includes a first contact surface, and each recessed portion of the plurality of recessed portions includes a second contact surface arranged to contact with the first contact surface; and a direction normal to the first contact surface is oriented away from the second housing segment.

3. The fan according to claim 2, wherein when the first and second housing segments, when detached from each other, are brought closer to each other in an axial direction, each projecting portion of the plurality of projecting portions is brought into contact with the second housing segment so as to be once elastically deformed radially outward or inward relative to the central axis and thereafter returns radially inward or outward relative to the central axis so that each projecting portion of the plurality of projecting portions is brought into axial engagement with the second housing segment.

4. The fan according to claim 1, wherein a radial thickness of the housing is arranged to decrease from the air inlet toward the air outlet, or to decrease from the air inlet toward the air outlet while being uniform over the at least one area.

5. The fan according to claim 4, wherein an outer circumferential surface of the housing is parallel to the central axis.

6. The fan according to claim 1, wherein a radial thickness of the housing is arranged to decrease from the air inlet toward the air outlet, or to decrease from the air inlet toward the air outlet while being uniform over the at least one area;

the plurality of projecting portions and the auxiliary projecting portions are arranged in the lower housing portion; and the plurality of recessed portions and the auxiliary recessed portions are arranged in the upper housing portion.

7. The fan according to claim 1, wherein when the first and second housing segments, when detached from each other, are brought closer to each other in an axial direction, each projecting portion of the plurality of projecting portions is brought into contact with the second housing segment so as to be once elastically deformed radially outward relative to the central axis, and thereafter returns radially inward relative to the central axis, so that each projecting portion of the plurality of projecting portions is brought into axial engagement with a corresponding one of the plurality of recessed portions; and a radially outer surface of each of the auxiliary projecting portions is arranged to be in contact with a corresponding one of the auxiliary recessed portions.

8. The fan according to claim 1, wherein the housing includes:

a plurality of upper flange portions each of which is arranged at an upper end of the housing in the vertical direction and arranged to project radially outward relative to the central axis; and a plurality of lower flange portions each of which is arranged at a lower end of the housing and arranged to project radially outward relative to the central axis, circumferential positions of the lower flange portions being arranged to coincide with circumferential positions of the upper flange portions; and circumferential positions of the increased thickness portions are arranged to coincide with the circumferential positions of the upper flange portions.

9. The fan according to claim 1, wherein the housing includes:

a plurality of upper flange portions each of which is arranged at an upper end of the housing in the vertical direction and arranged to project radially outward relative to the central axis; and a plurality of lower flange portions each of which is arranged at a lower end of the housing and arranged to project radially outward relative to the central axis, circumferential positions of the lower flange portions being arranged to coincide with circumferential positions of the upper flange portions;

circumferential positions of the increased thickness portions are arranged to coincide with the circumferential positions of the upper flange portions;

each of the upper and lower flange portions includes a hole arranged to permit a fastener to be inserted thereinto; and a radially outer surface of each of the plurality of projecting portions and the auxiliary projecting portions either defines a portion of an outer circumferential surface of the housing, or is positioned radially inward of the outer circumferential surface of the housing.

10. The fan according to claim 1, wherein the diameter of the inner circumferential surface of the housing is arranged to increase from the air inlet toward the air outlet.

11. The fan according to claim 10, wherein a portion of a section of the inner circumferential surface of the housing taken along a plane including the central axis, the portion extending between the air inlet and the air outlet, has an angle of inclination with respect to the central axis which becomes progressively smaller with the decreasing height.

12. The fan according to claim 1, wherein a section of the inner circumferential surface of the housing taken along a plane including the central axis includes, between the air inlet and the air outlet, a straight line which becomes progressively more distant from the central axis with the decreasing height.

13. The fan according to claim 1, wherein the plurality of ribs are a plurality of stationary vanes; and a distance between an upper end of the lower housing portion in the vertical direction and an upper end of an axial joint range in the vertical direction over which the lower housing portion and each stationary vane are joined to each other is smaller than a distance in the vertical direction between a lower end of the axial joint range and a lower end of the lower housing portion.

14. The fan according to claim 1, wherein the plurality of ribs are a plurality of stationary vanes; and a boundary between the upper and lower housing portions is arranged axially between a lower end in the vertical direction of the radially outer edge of each blade of the plurality of blades and an upper end of each stationary vane.

15. The fan according to claim 1, wherein the lower housing portion is capable of being fitted to the upper housing portion only when the lower housing portion is placed in a single predetermined circumferential position relative to the upper housing portion.

16. The fan according to claim 1, wherein a boundary between the upper and lower housing portions includes a radial shoulder.

17. The fan according to claim 1, wherein each of the plurality of projecting portions, have same shapes and each of the auxiliary projecting portions have same shapes.

18. A fan comprising:

an impeller;

a motor portion arranged to rotate the impeller about a central axis extending in a vertical direction;

a housing arranged to surround an outer circumference of the impeller; and a plurality of ribs, each of which is arranged to join the motor portion and the housing to each other; wherein the impeller includes a plurality of blades arranged to extend radially outward relative to the central axis;

an upper opening of the housing in the vertical direction is an air inlet, while a lower opening of the housing in the vertical direction is an air outlet;

the housing includes a plurality of decreased thickness portions and a plurality of increased thickness portions arranged alternately in a circumferential direction extending about the central axis;

a diameter of an inner circumferential surface of the housing is arranged to increase with a decreasing height in the vertical direction between the air inlet and an axial middle portion of a radially outer edge of each blade of the plurality of blades;

below the axial middle portion of the radially outer edge of each blade of the plurality of blades, the diameter of the inner circumferential surface of the housing is arranged to increase with the decreasing height in the vertical direction, to be uniform, or to increase with the decreasing height in the vertical direction while being uniform over at least one area;

a distance between the central axis and the radially outer edge of each blade of the plurality of blades is arranged to increase from the air inlet toward the air outlet;

the inner circumferential surface of the housing has a minimum radius smaller than a distance between the central axis and an outermost portion of the radially outer edge of each blade of the plurality of blades;

the housing includes:

an upper housing portion in the vertical direction; and a lower housing portion in the vertical direction arranged to be in contact with a lower portion in the vertical direction of the upper housing portion;

at a boundary between the upper and lower housing portions, the inner circumferential surface of the housing has a radius greater than the distance between the central axis and the outermost portion of the radially outer edge of each blade of the plurality of blades;

the lower housing portion, the plurality of ribs, and a base portion of the motor portion are defined by a single continuous monolithic member;

the increased thickness portions include a plurality of component fastening structures defining a fastening structure arranged to fit the upper and lower housing portions to each other;

the plurality of component fastening structures include:

a plurality of projecting portions arranged in a first housing segment and each arranged to extend toward a second housing segment, the first and second housing segments corresponding to a respective one of the upper and lower housing portions; and a plurality of recessed portions arranged in the second housing segment and each of which is arranged to have a separate one of the plurality of projecting portions fitted thereinto;

one of the first housing segment and the second housing segment includes auxiliary projecting portions, each of which is positioned adjacent to corresponding ones of the plurality of projecting portions or the plurality of recessed portions and is arranged to extend toward another one of the first housing segment and the second housing segment;

a radially outer surface of each of the plurality of projecting portions and the auxiliary projecting portions either defines a portion of an outer circumferential surface of the housing, or is positioned radially inward of the outer circumferential surface of the housing; and in the circumferential direction extending about the central axis when viewed from an air inlet end toward an air outlet end of the central axis, one of the auxiliary projecting portions is provided on a clockwise side of a corresponding one of the plurality of projecting portions and all remaining ones of the auxiliary projecting portions are provided on counterclockwise sides of all remaining corresponding ones of the plurality of projecting portions, every one of the increased thickness portions includes one of the plurality of projecting portions and one of the auxiliary projecting portions.

19. The fan according to claim 18, wherein each of the plurality of projecting portions have same shapes and each of the auxiliary projecting portions have same shapes.

* * * * *